United States Patent [19]

Miller et al.

[11] 4,230,592

[45] Oct. 28, 1980

[54] CONTROLLED FOAM DETERGENT ADDITIVE

[75] Inventors: Jack Miller; Thomas C. Tesdahl, both of Cincinnati, Ohio

[73] Assignee: Chemed Corporation, Cincinnati, Ohio

[21] Appl. No.: 44,396

[22] Filed: May 31, 1979

[51] Int. Cl.[3] ..... C11D 7/06

[52] U.S. Cl. ..... 252/156; 252/175; 252/180

[58] Field of Search ..... 252/156, 180, 175

[56] References Cited

U.S. PATENT DOCUMENTS

| | | | |
|---|---|---|---|
| 2,976,248 | 3/1961 | Otrhalek | 252/156 |
| 2,992,187 | 7/1961 | Gershon | 252/156 |
| 3,278,446 | 10/1966 | Irani | 252/156 X |
| 3,653,095 | 4/1972 | Dupre | 252/156 |
| 3,673,098 | 6/1972 | Sabatelli et al. | 252/156 |
| 3,705,856 | 12/1972 | Sedliar et al. | 252/156 |
| 3,966,628 | 6/1976 | Woodward | 252/156 X |
| 4,001,133 | 1/1977 | Sorgenfrei | 252/156 |

OTHER PUBLICATIONS

The Condensed Chemical Dictionary, 1966, p. 87.

McCutcheons–Detergents & Emulsifiers, 1972, pp. 136 & 186.

*Primary Examiner*—Mayer Weinblatt

*Attorney, Agent, or Firm*—Charles L. Harness

[57] ABSTRACT

Liquid additive for caustic soda cleaning solutions. Provides surfactants, foam control, and scale control; and good wetting and emulsifying properties for improved cleaning and ease of rinsing.

3 Claims, No Drawings

CONTROLLED FOAM DETERGENT ADDITIVE

The instant invention is directed to an aqueous solution of caustic potash, a phosphonate, a dicarboxylic acid, sodium glucoheptonate or gluconate, sodium nitrite, linear alcohol alkoxylate, and alkyl glucosides. The solution is especially designed for addition to caustic soda cleaning solutions for improved cleaning, wetting, emulsifying, anti-scaling, ease of rinsing, and foam control.

Many food processing industries such as dairies, canneries, and beverage plants have traditionally utilized liquid caustic soda at various levels of causticity for recirculation, soaker, spray washer, or high pressure CIP ("cleaning-in-place") cleaning. Most use 50% caustic soda, which is diluted with water to the desired use concentration. The additives are then added to the use dilution to control hard water and scale buildup, with the better ones also containing some wetting agents for improved soil removal and complete rinsing. The product of this invention on the other hand can be added directly to the bulk 50% caustic soda at the desired level to provide at use dilution, hard water control, reduced scale buildup as well as the wetting ability for improved soil removal and rinsing properties. This alleviates the labor and cost involved with manually or mechanically adding the required additives each time the caustic is diluted for use.

In use, the instant formulation is added to aqueous caustic soda, suitably in the ratio of 1 to 6 gallons of formulaton per 30 gallons of aqueous caustic soad, 50% NaOH basis.

The user can then further dilute as desired, depending on end use. For example in beverage plants the caustic soda/formulation solution is customarily diluted down to 3.5% NaOH.

Our formulation is preferably used in caustic soda solutions used at about 140°-160° F.

In the Table following, the "Preferred Formula" represents the preferred embodiment of the invention. The "Broad Range Formula" represents ranges of the respective components that give an operable formulation, i.e., one meeting generally the basic characteristics and function of the Preferred Formula. "Narrow Range Formula" presents more restricted component ranges within "Broad Range Formula", and encompassing "Preferred Formula". These "Narrow Ranges" use minor modifications of the "Preferred Formula" with very little resulting change in properties.

Storage tests have shown the Preferred Formula product to be stable at 120° F., 75° F., 40° F., and 0° F. for one month. Storage tests at a 1 to 10 dilution in 50% liquid caustic soda were stable at 75° F. and 105° F. for one month.

In the Table, caustic potash, KOH, is formulated as a commercial 45-47% aqueous solution. On a dry basis (of 100% KOH basis) each value listed for KOH should be multiplied by 0.45-0.47, or on an average, 0.46. Thus 9.50% wet basis is 4.37% dry basis; 3.0-15.0 is 1.4-6.9; and 5.5-12.0 is 2.53-5.52. If the calculation is made on this basis, the difference in water is added to the % water range. E.g., 9.50-4.37 or 5.13% is added to 49.25 to give 54.38% water in the Preferred Formula; 3.0-1.4 or 1.6 is added to 6.0 to give 7.6 and 15.0-6.9 or 8.1 is added to 86.95 to give 95.05 in the Broad Range formula, and so on. Obviously, in both the Broad Range and Narrow Range formulas, amounts of components must be selected within the ranges so as not to exceed a total of 100%. For example, in the Broad Range formula the maximum of water cannot be taken with the maximum of KOH without exceeding 100%.

Again referring to the Table, it will be noted that amino trimethylphosphonic acid (AMP) is 40% active. The figures for AMP can be converted to 100% active basis by multiplying the respective values by 40%. Thus, in the Preferred Formula, $6.25 \times 0.4 = 2.5\%$, 100% basis, and so on. Similarly, the alkyl glucosides have a 70% active content, so that in the Preferred Formula, to convert 8.50% to 100% active, one multiples $8.5 \times 0.7 = 5.95\%$. It follows that if it is desired to use an equivalent amount of component of a different active content, one simply converts back from 100% active. Thus, if instead of 40% aminotrimethylphosphonic acid (AMP) one desires to use 30% in the Preferred Formula, one divides the 100% basis by 30%, thus $2.5\%/0.3 = 8.3\%$.

TABLE

| Components | Preferred Formula Wt. % | Broad Range Formula Wt. % | Narrow Range Formula Wt. % |
|---|---|---|---|
| Water | 49.25 | 6.0-86.95 | 27.0-73.75 |
| Caustic potash (Potassium hydroxide, 45-47%) | 9.50 | 3.0-15.0 | 5.5-12.0 |
| Amino tri methyl phosphonic acid (AMP), 40% active | 6.25 | 2.0-10.0 | 3.75-8.0 |
| Cycloaliphatic $C_{21}$ dicarboxylic acid[1] | 2.50 | 0.5-8.0 | 1.50-4.0 |
| Sodium glucoheptonate[2] | 20.00 | 5.0-35.0 | 10.0-30.0 |
| Sodium nitrite | 2.00 | 0.5-5.0 | 1.0-3.0 |
| Linear alcohol alkoxylate[3] | 2.00 | 0.05-5.0 | 0.5-4.0 |
| Alkyl glucosides, 70% active[4] | 8.50 | 2.0-16.0 | 4.0-12.0 |

[1]Made from mix of tall oil fatty acids plus acrylic acid by process of U.S. Pat. No. 3 753 968; available commercially from Westvaco Corporation as 1550 Diacid. U.S. Pat. No. 3 753 968 gives the formula of the dicarboxylic acid as

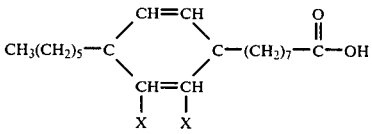

wherein one X is hydrogen and the other X is a carboxylic acid group.

[2]A useful alternate is sodium gluconate.

[3]An alpha alkyl hydroxypolyoxyethylene/oxypropylene cyclic polymer in which alkyl is $C_{12-15}$, oxyethylene content is 8-13 moles, oxypropylene content is 7-30 moles, average moles of ethylene oxide is 9, and average moles of propylene oxide is 15. Available commercially as Polytergent S-305-LF from Olin corp.

[4]The reaction product of a monosaccharide and a primary alcohol having 6-18 carbon atoms. The preferred alcohol has 8-10 carbons with about 45% $C_8$ and 55% $C_{10}$ distribution. The latter gives a mixture of octyl and decyl glucosides. These alkyl glucocides can be made by the process of U.S. Pat. No. 3 839 318 and are available commercially as Triton BG-10 from Rohm & Haas Corp.

In our compositon, AMP is used for scale control. The dicarboxylic acid is used to help couple the linear alcohol alkoxylate (which is a low foam surfactant), and also provides some wetting and detergency. The sodium salt of sugar acid (i.e., glucoheptonate or gluconate) is a sequestrant. Sodium nitrite is a corrosion inhibitor. The alkyl glucoside mix (e.g., Triton BG-10) couples our formulation into 50% caustic soda. This glucoside mix is a moderate foamer which requires the addition of a low foam surfactant (in the preferred case, the linear alcohol alkoxylate Polytergent S-305-LF) to control the foam level when the formulation/caustic soda mix is used in high pressure spraying operations.

EXAMPLE 1

The concentrate as represented by the Preferred Formula in the Table is prepared as follows. These ingredients are added in order given in the Preferred Formula to a clean stainless steel kettle with a source of heat and a mixer capable of maintaining a slight vortex throughout the manufacturing process. Any foaming contaminating cannot be tolerated. The water is added first at 60° F.–80° F. Then the caustic potash is added and mixed into solution. The AMP is added with mixer on as heat is evolved and agitation will prevent localized heating and spattering. The dicarboxylic acid is then added with agitation at a minium batch temperature of 120° F., and mixed for 15 to 30 minutes to allow complete neutralization. At this point, the remaining ingredients are added with agitation insuring that each is completely in solution before the next addition is made. After the alkyl glucoside is added, the batch is mixed an additional 30 minutes.

The result is a unique blend of surfactants that react synergistically to provide a stable concentrate, which is low foaming at use concentrations and temperature as well as soluble and stable in 50% caustic soda.

We claim:

1. Composition consisting essentially of:

| Components | Wt. % |
|---|---|
| Water | 6.0–86.95 |
| Potassium hydroxide, dry basis | 1.4–6.9 |
| Amino tri methyl phosphonic acid, 40% active | 2.0–10.0 |
| 100% active | 0.8–4.0 |
| Cycloaliphatic $C_{21}$ dicarboxylic acid of the formula | 0.5–8.0 |

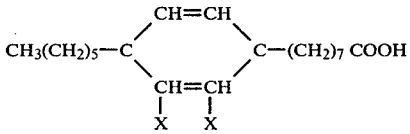

-continued

| Components | Wt. % |
|---|---|
| in which one X is hydrogen and the other is a carboxylic acid group. | |
| Sodium glucoheptonate or gluconate | 5.0–35.0 |
| Sodium nitrite | 0.5–5.0 |
| Linear alcohol alkoxylate, being an alpha alkyl hydroxypolyoxyethylene/oxypropylene cyclic polymer in which alkyl is $C_{12-15}$, oxyethylene content is 8–13 moles, oxypropylene content is 7–30 moles, average moles of ethylene oxide is 9, and average moles of propylene oxide is 15 | 0.05–5.0 |
| Alkyl glucosides in which alkyl has 6–18 carbon atoms, 70% active | 2.0–16.0 |
| 100% active | 1.4–11.2 |

2. Composition according to claim 1, consisting essentially of:

| Components | Wt. % |
|---|---|
| Water | 27.0–73.75 |
| Caustic potash (Potassium hydroxide, 45–47%) | 5.5–12.0 |
| Amino tri methyl phosphonic acid, 40% active | 3.75–8.0 |
| Cycloaliphatic $C_{21}$ dicarboxylic acid | 1.50–4.0 |
| Sodium glucoheptonate | 10.0–30.0 |
| Sodium nitrite | 1.0–3.0 |
| Linear alcohol alkoxylate | 0.5–4.0 |
| Alkyl glucosides in which alkyl is 45% $C_8$ and 55% $C_{10}$ 70% active | 4.0–12.0 |

3. Composition according to claim 2, consisting essentially of:

| Components | Wt. % |
|---|---|
| Water | 49.25 |
| Caustic potash (Potassium hydroxide, 45–47%) | 9.50 |
| Amino tri methyl phosphonic acid, 40% active | 6.25 |
| Cycloaliphatic $C_{21}$ dicarboxylic acid | 2.50 |
| Sodium glucoheptonate | 20.00 |
| Sodium nitrite | 2.00 |
| Linear alcohol alkoxylate | 2.00 |
| Alkyl glucosides | 8.50 |

* * * * *